United States Patent [19]

Gassmann

[11] 4,056,935

[45] Nov. 8, 1977

[54] DAMPING CHAMBER FOR AN EXPLOSIVE CHARGE-DRIVEN FASTENING ELEMENT SETTING GUN

[75] Inventor: Horst-Detlef Gassmann, Schaan, Liechtenstein

[73] Assignee: Hilti Aktiengesellschaft, Schaan, Liechtenstein

[21] Appl. No.: 639,048

[22] Filed: Dec. 9, 1975

[30] Foreign Application Priority Data

Dec. 20, 1974 Germany ..... 7442603[U]

[51] Int. Cl.[2] ..... F01B 29/08; B25C 1/12

[52] U.S. Cl. ..... 60/632; 60/635; 60/638; 173/DIG. 2; 227/8; 227/10

[58] Field of Search ..... 60/632, 635, 636, 637, 60/638; 227/8, 9, 10; 173/DIG. 2

[56] References Cited

U.S. PATENT DOCUMENTS

| | | | |
|---|---|---|---|
| 2,518,395 | 8/1950 | Sopris | 60/638 |
| 2,975,595 | 3/1961 | Lyons | 60/632 |
| 3,120,591 | 2/1964 | Lewis | 60/635 |
| 3,850,359 | 11/1974 | Obergfell | 60/632 |

*Primary Examiner*—Ronald H. Lazarus
*Assistant Examiner*—Daniel J. O'Connor
*Attorney, Agent, or Firm*—Toren, McGeady and Stanger

[57] ABSTRACT

In an explosive charge-driven fastening element setting gun having a casing and a muzzle tube axially displaceably mounted in the casing, a damping housing is arranged to receive explosive gases passing laterally out of the gun. The damping housing surrounds the gun and is formed of two parts, one fitting into the other in a telescoping manner. One part is attached to the muzzle tube and the other part is fixed to the casing. Packing is secured to one of the parts and extends into contact with the other part in the region where the parts are telescopically fitted together.

9 Claims, 2 Drawing Figures

1
2
3
3a
4
4a
5
6
7
8
9
9a
10
10a
10b
11
12
13
14
14a
15
16
16a
16b
17
17a
18
19
A
A'
A''

DAMPING CHAMBER FOR AN EXPLOSIVE CHARGE-DRIVEN FASTENING ELEMENT SETTING GUN

SUMMARY OF THE INVENTION

The present invention is directed to an explosive charge-driven fastening element gun in which a muzzle tube is axially displaceable within the front end of a casing and, more particularly, is directed to a two-part damping housing mounted on the muzzle tube and on the casing to collect explosive gases flowing from gas outlet orifices in the muzzle tube and casing.

Explosive charge-driven fastening element setting guns are used to drive bolts, studs, nails and similar elements into a receiving material, generally a hard receiving material. The use of an explosive charge as the source of driving energy results, quite naturally, in considerable noise when a fastening element is being driven and, for obvious reasons, attempts have been made to keep the noise generated in the setting operation as low as possible.

In known guns which have outwardly directed gas outlet orifices, located either in the gun casing or in the muzzle tube, explosion chambers are provided on the casing or on the muzzle tube outwardly from the gas outlet orifice and the chambers are formed of different hollow bodies in which the explosive gases are caught for absorbing the sound generated.

These known sound absorbing devices may not be used in setting guns which have gas outlet orifices in the range of both the casing and the muzzle tube and where the muzzle tube is axially displaceable relative to the casing. Particularly, in setting guns where the gas outlet orifices are arranged in the muzzle tube adjacent to the front end of the casing, the arrangement of a hollow body on the muzzle tube would result at least in impairment to the axial displaceability of the tube relative to the casing for proper operation of the setting gun, however, the limitation on the axial displaceability of the muzzle tube is not acceptable.

Accordingly, the present invention concerns a fastening element setting gun of the muzzle tube-casing type which ensures effective sound absorption without impairing the axial displaceability of the muzzle tube.

In accordance with the present invention, the damping housing forms a closed chamber about the setting gun and the gas outlet orifices arranged in both the muzzle tube and the casing opening into the chamber. Accordingly, explosive gases escaping through the gas outlet orifices are collected and expanded in the damping housing chamber in any operating position of the setting gun, so that a considerable sound absorption is obtained without impairing the operation of the gun.

Various materials can be used in forming the damping housing, however, a steel housing has been found particularly expedient for use in the rough operation experienced by setting guns on construction sites.

With regard to its form, the damping housing can be designed as a hollow body of different configuration arranged about the gas outlet orifices. If a compact, relatively easy to produce model is required, it is preferable if the damping housing is designed as a hollow cylinder. At its ends, the hollow cylindrical-shaped damping housing has ring shoulders extending radially inwardly into bearing contact with the muzzle tube and the casing.

In the case of a one-part damping housing, it must be arranged on the casing or on the muzzle tube and secured against displacement. With this arrangement the muzzle tube can be displaced relative to the casing without any obstruction, for affording an effective sound absorption.

For setting guns having a muzzle tube which must be displaced over a considerable axial distance relative to the casing, it is preferable if the damping housing is formed of two mutually displaceable parts, one fitting into the other in a telescoping manner to provide a closed hollow chamber in accordance with the present invention. As the highest pressure explosive gases issue from the gas outlet orifices in the muzzle tube casing, the closed chamber formed by the two interfitting parts provides for the expansion of the gases. If the muzzle tube is displaced in the driving direction relative to the casing after an explosive charge is fired, the annular closed chamber at first increases in volume, which increase has a positive effect on the sound absorption. During further movement of the muzzle tube in the same direction away from the casing, the telescoping arrangement of the parts is eliminated and the explosive gases expanded in the chamber can issue into space about the setting gun without any marked noise.

Preferably, packing is arranged on one of the parts of the damping housing at the location where the two parts fit one into the other. In such an arrangement, the packing is held in place and the risk of displacement of the packing during the displacement of the muzzle tube relative to the casing is eliminated.

In accordance with the invention, the packing is designed as a lamellar packing, which has the advantage of ensuring satisfactory packing qualities even if one of the parts of the damping chamber is deformed, such as may occur during improper handling of the gun.

When a two-part damping housing is used with a lamellar packing between the two parts, a particularly suitable material for the damping housing is a rubber or plastic material which is relatively insensitive to heat and cold.

In accordance with the invention, one part of the damping housing is attached to the casing and the other part is secured to the muzzle tube. This ensures that the parts of the damping housing are not displaced on the casing or the muzzle tube and thus assures the telescoping arrangement necessary for the packing to effect a closure between the parts when the setting gun is used.

The various features of novelty which characterize the invention are pointed out with particularity in the claims annexed to and forming a part of this specification. For a better understanding of the invention, its operating advantages and specific objects attained by its use, reference should be had to the accompanying drawing and descriptive matter in which there is illustrated and described a preferred embodiment of the invention.

DETAILED DESCRIPTION OF THE INVENTION

Figure 1:
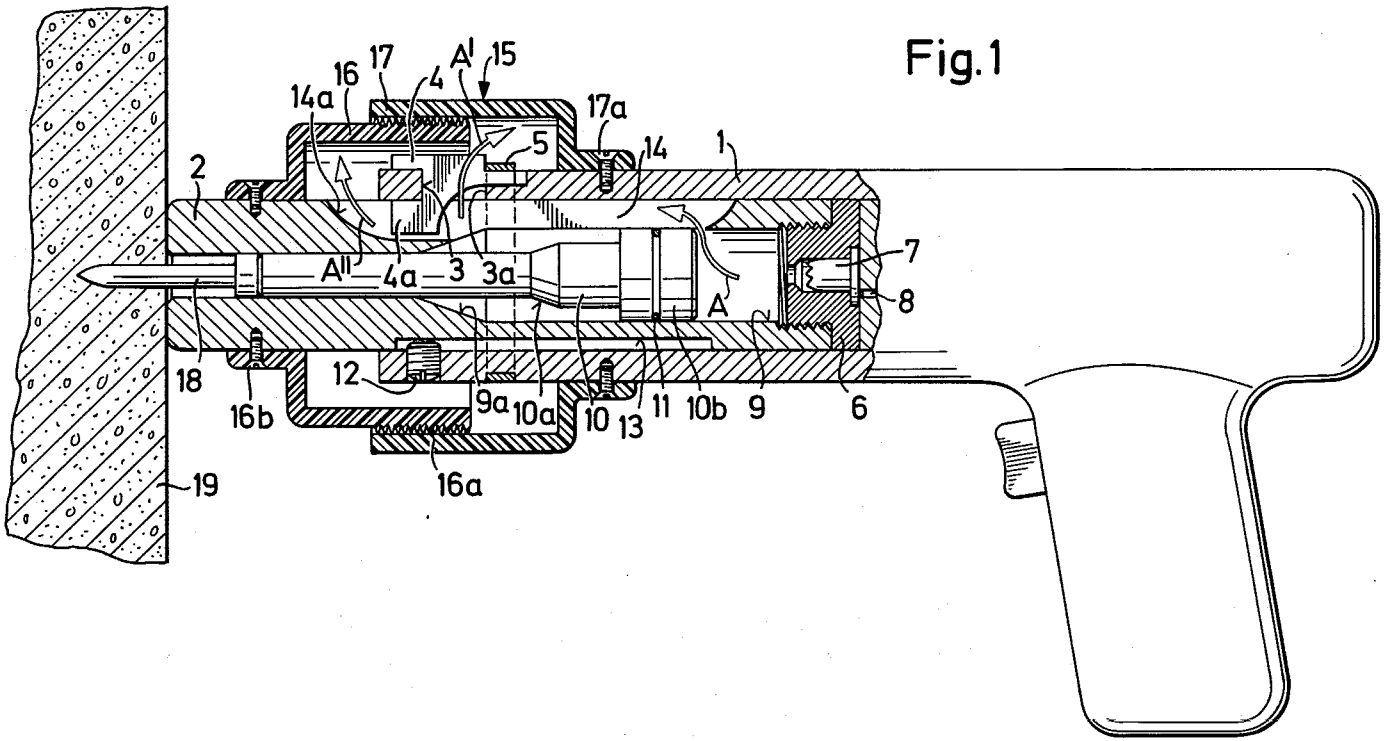
FIG. 1 is a side view, partly in section, of a fastening element setting gun which embodies the present invention and shows the gun driving a fastening element into a receiving material.
Figure 2:
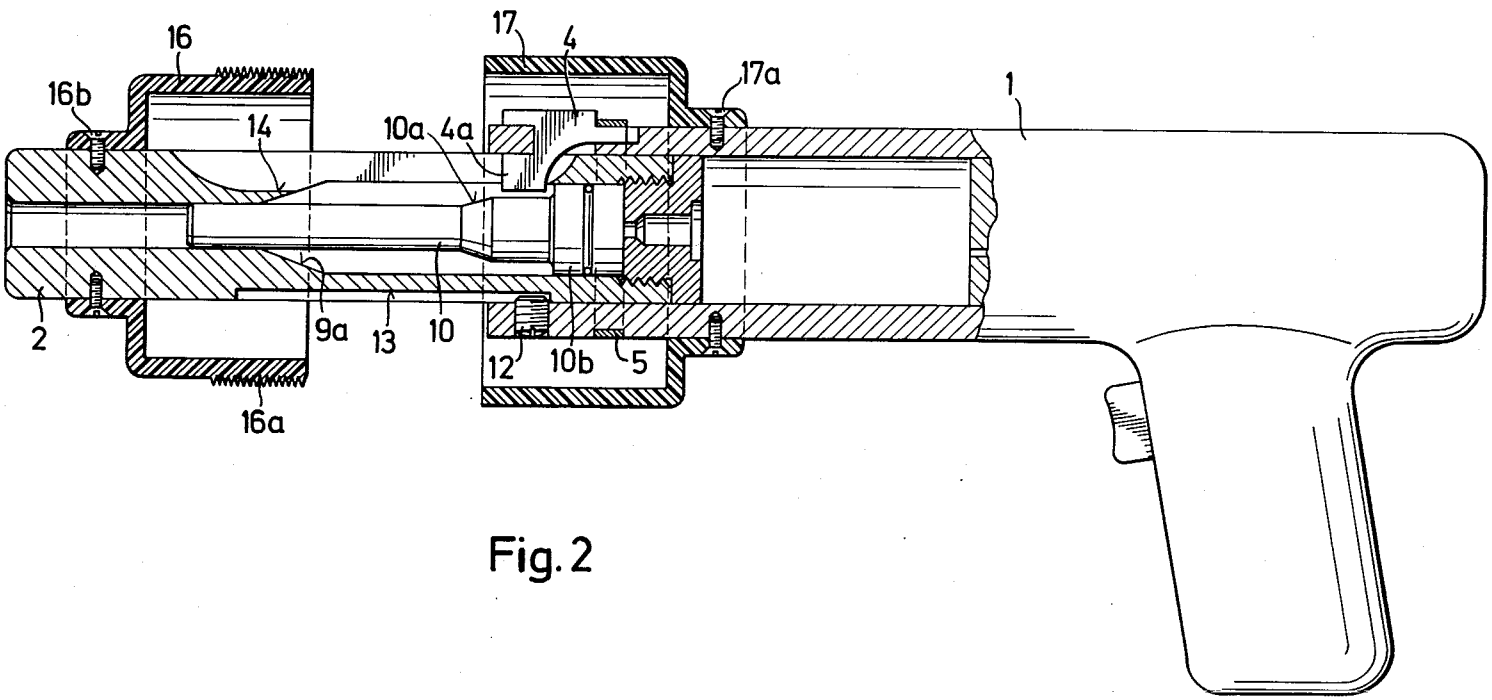
FIG. 2 illustrates the setting gun shown in FIG. 1, partly in section, with the muzzle tube displaced outwardly from the casing.

In FIGS. 1 and 2 a fastening element setting gun is illustrated, consisting of a casing 1 having a bore facing in the firing direction and a muzzle tube 2 axially displaceably mounted within the casing bore with with forward portion of the tube projecting outwardly from the front end of the casing. At its front end, casing 1 has a slot 3 through which a latch 4 projects. The latch has a nose 4*a* extending radially inwardly into the path of the muzzle tube 2. An annular spring 5 extending around the casing secures the latch 4 to the casing. The muzzle tube 2 forms the barrel or the setting gun and has a screw cap 6 fitted into the rear end of the tube. The locking cap forms a cartridge chamber, shown in FIG. 1 containing a cartridge 7. Positioned in the casing 1 rearwardly of the muzzle tube is a firing pin 8 used to ignite the cartridge 7. The firing pin is part of a conventional firing mechanism, accordingly, further illustration is not provided. The muzzle tube 2 forms an axially extending stepped bore 9 with the bore having a larger diameter at its rearward end and a smaller diameter at its forward end. The transition 9*a* between the rearward and forward ends of the bore serves as a striking surface for a driving piston 10 axially displaceable through the bore. Intermediate its ends, the driving piston 10 has a frusto-conically shaped shoulder 10*a* which corresponds in shape to the transition 9*a*. To prevent any undesired movement of the driving piston 10 within the bore 9, a friction spring 11 encircles the enlarged head end of the piston and bears against the surface of the larger diameter end bore. Due to the arrangement of the friction spring 11, if the setting gun is pointed downwardly, there will not be any undesired movement of the piston toward the front end of the muzzle tube.

Positioned in the lower portion of the casing 1, as viewed in FIGS. 1 and 2, is a stop screw 12 which extends into an axially extending groove 13 in the surface of the muzzle tube 2. The engagement of the screw 12 within the groove 13 limits the axial displaceability of the muzzle tube in the driving direction. In addition, the muzzle tube has a longitudinally or axially extending slot 14, formed, for example, by milling, into which the nose 4*a* of the latch 4 projects. As seen in FIG. 1, with the muzzle tube inserted for its full extent into the casing 1, the front end of the slot 14 is located forwardly of the front end of the casing 1. Accordingly, the forward end of the slot 14 forms a front gas outlet orifice 14*a* from the muzzle tube. Moreover, a rear gas outlet orifice 3*a* is provided by the clearance between the slot 3 in the casing and the latch 4 so that the rear gas outlet orifice opens through the front end of the casing. As indicated by FIG. 1, both the front and rear gas outlet orifices 14*a*, 3*a* are enclosed by a hollow cylindrical damping housing 15 spaced radially outwardly from the exterior surfaces of the muzzle tube and the casing. The damping housing 15 consists of a front part 16 and a rear part 17. The front part 16 is secured by screws 16*b* to the muzzle tube 2, while the rear part 17 is similarly secured by screws 17*a* to the casing 1. The front part 16 fits in a telescopic manner into the rear part 17 and over the range of the portion of the front part which fits into the rear part, a circumferentially extending lamellar packing 16*a* is provided on the outer surface of the front part. Accordingly, the packing 16*a* provides a sliding closure between the two parts of the damping housing.

When a bolt 18 is driven into a receiving material 19, as shown in FIG. 1, the explosive gases, effecting the driving of the piston act, on the piston head 10*b* driving it toward the front end of the muzzle bore. As a result, the gases flow along the path indicated by the arrows A, A′ and A″ passing through the bore 9 and entering into the longitudinal slot 14. From the slot 14 the gases flow through the gas outlet orifices 14*a*, 3*a* into the closed annular chamber formed by the damping housing 15.

After a fastening element has been driven into the receiving material, the position of the setting gun shown in FIG. 2 is achieved by pulling the muzzle tube 2 manually in the driving direction, outwardly from the bore in the casing 1. The extent of the axial movement of the muzzle tube is limited by the action of the stop screw 12 within the groove 13. The purpose of axially displacing the muzzle tube in the forward direction is to return the driving piston 10 into its rear position within the bore in the muzzle tube 2. The rearward displacement of the driving piston 10 during the forward movement of the muzzle tube takes place automatically as the nose 4*a* of the latch contacts the shoulder formed by the forward end of the head 10*b* of the piston. Explosive gases, collected within the closed chamber in the damping housing during the fastening element driving operation, escape when the muzzle tube is pulled forwardly, since the telescoping parts 16, 17 are separated.

The damping housing, according to the present invention, can also be used in setting guns which do not incorporate a driving piston 10.

While a specific embodiment of the invention has been shown and described in detail to illustrate the application of the inventive principles, it will be understood that the invention may be embodied otherwise without departing from such principles.

What is claimed is:

1. An explosive charge driven fastening element setting gun comprising a casing having a front end facing in the firing direction and an oppositely directed rear end, with the front end of the casing forming a bore extending in the firing direction, an axially elongated muzzle tube having a front end facing in the firing direction and oppositely directed rear end, said muzzle tube axially displaceably mounted in the bore in the front end of said casing and the front end of said muzzle tube projecting outwardly from the front end of said casing, at least one of said casing and said muzzle tube having a gas outlet orifice opening laterally therefrom, wherein the improvement comprises a damping housing mounted on said casing and on said muzzle tube and forming a closed chamber covering said gas outlet orifice for receiving explosive gases flowing therefrom and said closed chamber being openable for releasing the explosive gases collected therein.

2. An explosive charge driven fastening element setting gun, as set forth in claim 1, wherein said damping housing is cylindrically shaped and is spaced radially outwardly from said casing and said muzzle tube forming an annular chamber extending around said casing and muzzle tube.

3. An explosive charge driven fastening element setting gun, as set forth in claim 2, wherein said damping housing is formed of two mutually displaceable parts.

4. An explosive charge driven fastening element setting gun, as set forth in claim 3, wherein one of said parts is secured on said casing and the other said part is secured on said muzzle tube, with said parts fitting one into the other in a telescoping manner.

5. An explosive charge driven fastening element setting gun, as set forth in claim 4, wherein said damping housing includes an annular ring of packing positioned between said parts of said damping housing where they fit together in a telescoping manner.

6. An explosive charge driven fastening element setting gun, as set forth in claim 5, wherein said packing is affixed to one of said parts of said damping housing.

7. An explosive charge driven fastening element setting gun, as set forth in claim 6, wherein said packing has a lamellar structure.

8. An explosive charge driven fastening element setting gun, as set forth in claim 7, wherein the laminations of the lamellar structure of said packing extend transversely of the axial direction of said muzzle tube.

9. An explosive charge driven fastening element setting gun, as set forth in claim 4, wherein said muzzle tube has an axially extending slot for conveying explosive gases from within said muzzle tube to said gas outlet orifice, means in said casing for limiting the axial displacement of said muzzle tube relative to said casing, a driving piston axially displaceably positioned within said muzzle tube, and means mounted in said casing and extending through said axially extending slot in said muzzle tube into the path of movement of said driving piston for displacing the driving piston through said muzzle tube when the muzzle tube is pulled axially outwardly from said casing.

* * * * *